United States Patent [19]

Schoch

[11] Patent Number: 4,551,932

[45] Date of Patent: Nov. 12, 1985

[54] SKI BOOT CONSTRUCTION

[75] Inventor: Robert Schoch, Hilzingen, Fed. Rep. of Germany

[73] Assignee: Weinmann GmbH & Co. KG, Singen, Fed. Rep. of Germany

[21] Appl. No.: 594,193

[22] Filed: Mar. 28, 1984

[30] Foreign Application Priority Data

Apr. 26, 1983 [DE] Fed. Rep. of Germany ..... 3315071
May 16, 1983 [DE] Fed. Rep. of Germany ..... 3317771

[51] Int. Cl.[4] ..... A43B 5/04; A43C 11/20

[52] U.S. Cl. ..... 36/117; 36/50; 36/54; 36/120

[58] Field of Search ..... 36/117–121, 36/54, 50; 24/68 SK, 69 SK, 70 SK, 71 SK

[56] References Cited

U.S. PATENT DOCUMENTS 3,820,256 6/1974 Schoch ..... 36/120
4,480,395 11/1984 Schoch ..... 36/50

FOREIGN PATENT DOCUMENTS 2341658 3/1974 Fed. Rep. of Germany ..... 36/117
2820074 11/1979 Fed. Rep. of Germany ..... 36/117
2900077 7/1980 Fed. Rep. of Germany ..... 36/50

*Primary Examiner*—James Kee Chi
*Attorney, Agent, or Firm*—Learman & McCulloch

[57] ABSTRACT

A ski boot has a frontal opening adapted to be closed by a tongue. The tongue carries a latching mechanism having fastening members that may be moved into and out of engagement with anchor members fixed to the boot on opposite sides of the opening. The tongue wholly overlies the fastening members and the anchor members when the boot is in use, thereby minimizing the possibility of icing of the tongue latching mechanism.

12 Claims, 9 Drawing Figures

FIG. 5
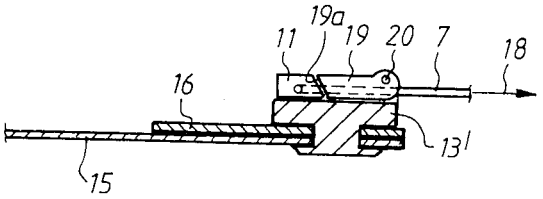
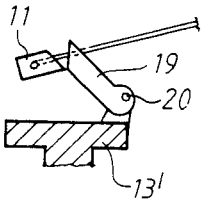
FIG. 6
FIG. 7
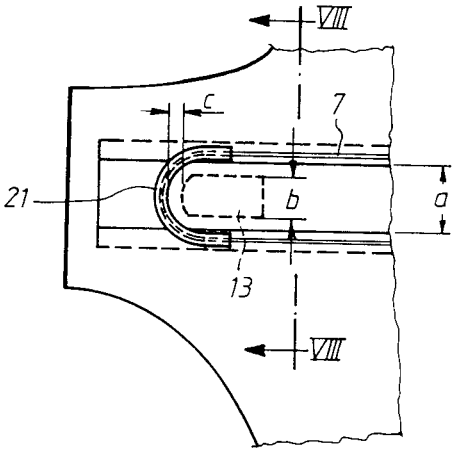
FIG. 8
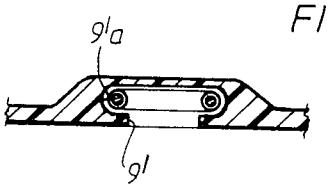

SKI BOOT CONSTRUCTION

The invention relates to a ski boot having a frontal opening therein adapted to be covered by a tongue on which a rotatable closure operator is mounted.

BACKGROUND OF THE INVENTION

A known ski boot (disclosed in German Pat. No. 22 13 720) has a frontal opening normally closed by an overlying tongue hinged at its lower end to the boot. The boot has two fastening members connected to a rotary operating member carried by the tongue. The fastening members are constructed as tie loops which overlie and project laterally over the tongue. When closing the ski boot the wearer uses one hand to press the tongue against the frontal surface of the boot while using the other hand to guide the ends of the two tie loops onto two hook-like anchor elements fixed on the boot, and then uses the other hand to tighten the two tie loops by rotating the operating member.

An object of the present invention is to improve the known ski boot by simplifying the closure of the boot and minimizing the exposure of the operating mechanism to icing.

SUMMARY OF THE INVENTION

In a ski boot according to the invention the two fastening members are covered and guided by the tongue so that, when closing the ski boot, the wearer is no longer subject to the necessity of having to guide the fastening members with one hand onto the hook-like anchor elements fixed on the shell of the ski boot. In the construction according to the invention the two fastening members engage automatically with the anchor elements when the wearer presses the tongue against the front of the boot and actuates the rotatable operating member in the direction of latching movement. In the construction according to the invention it is equally unnecessary to manipulate the fastening members when opening the ski boot; by simply rotating the operating member (in the direction of an opening movement) and then pushing the upper part of the tongue forwards, the engagement of the fastening members with the anchor elements is released. In this way the manipulation of the central closure tongue is simplified for the user both for closing and opening the ski boot.

A further advantage of a boot constructed according to the invention lies in the good protection against icing of the covered fastening members. Since the guides for the fastening members are practically completely closed off towards the exterior by the tongue, snow or ice is prevented from settling in the region of the fastening members and the anchor elements and is thus prevented from hindering the latching or releasing of the tongue during opening or closing of the ski boot.

DESCRIPTION OF THE DRAWINGS

Further features of the invention are set forth in the following description and illustrated in the accompanying drawings, wherein:

FIG. 5 is a section (similar to FIG. 4) through a modified embodiment of the invention in the closed position;

FIG. 6 is a section through a part of the apparatus shown in FIG. 5 during opening of the closure;

FIG. 7 is a plan view (similar to FIG. 2) of a further embodiment of the invention;

FIG. 8 is a section along the line VIII—VIII of FIG. 7; and

DETAILED DESCRIPTION

Figure 1:
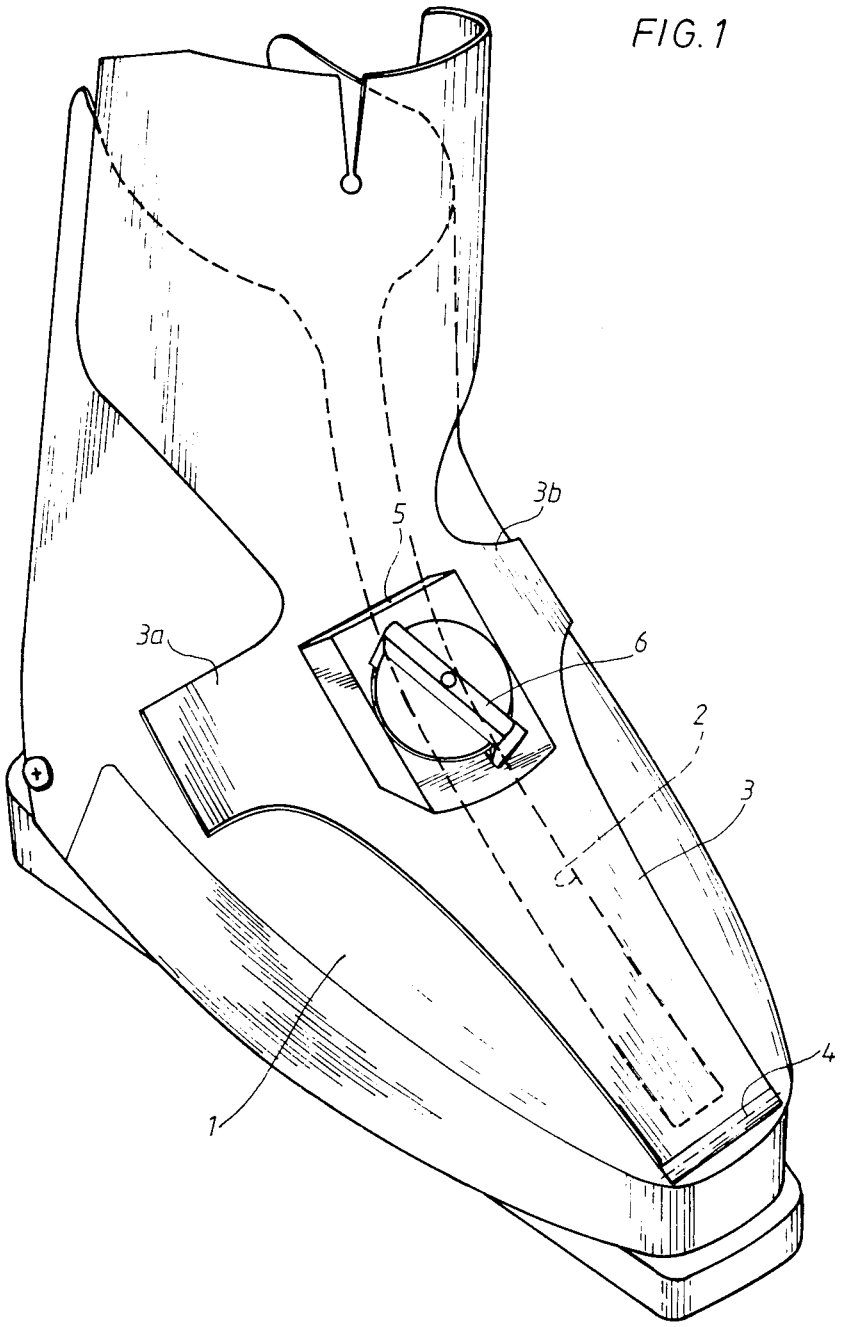
FIG. 1 is a perspective view of a ski boot constructed according to the invention.

The ski boot shown schematically in FIG. 1 comprises an outer boot formed by a rigid plastic shell 1 in which an inner boot (not shown) made from foam material is located. The shell 1 is provided with a frontal opening 2 which facilitates the introduction of the inner boot into the shell 1 and the putting on and taking off of the ski boot.

The opening 2 of the shell 1 is covered by a tongue 3 made from rigid plastic and is pivotable about a hinge 4 which is only schematically indicated.

The tongue 3 supports a housing 5 of known construction which mounts a rotatable closure operating member 6.

Figure 2:
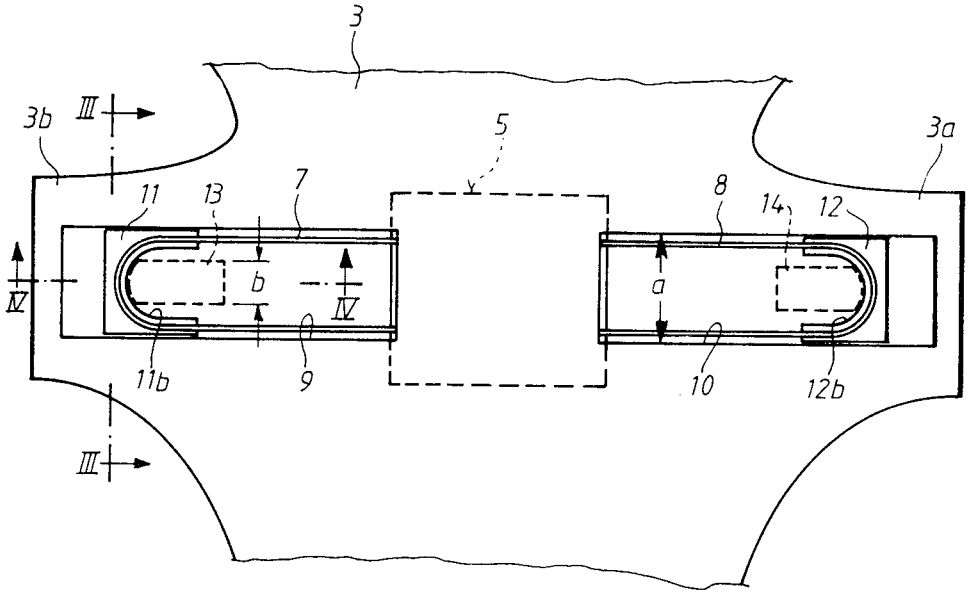
FIG. 2 is a bottom plan view of part of the tongue.

As can be seen from FIG. 2, two fastening members 7, 8 are constructed as tie loops and are connected in a known manner to the rotatable closure operating member 6. The connection can be made for example by means of a Maltese cross transmission so that the effective length of the fastening members 7, 8 is altered by rotation of the closure member 6.

Figure 3:
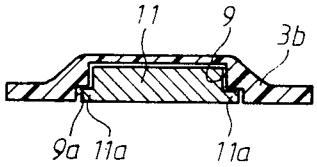
FIG. 3 is a section along the line III—III in FIG. 2.

At the level of the closure operating member 6 the tongue 3 is provided with two lateral extensions 3*a*, 3*b* which serve to cover completely the two fastening members 7, 8. On its underside the tongue 3 is provided in the region of the lateral extensions 3*a*, 3*b* with T-shaped recesses 9, 10 which serve to receive the fastening members 7, 8 and to guide T-shaped slides 11, 12. These slides 11, 12 are connected to the free ends of the fastening members 7, 8. They also engage in the manner shown in FIG. 3 with a lateral edge (e.g. 11*a*) in the recess edge 9*a*. The slides 11, 12 are guided in this way in the recesses 9 and 10 so as to be slidably movable and at the same time secured against falling out of these recesses.

On their inner surface facing the housing 5 the slides 11, 12 are provided with a semi-circular recess 11*b* or 12*b* for the reception of hook-like anchor elements 13, 14 which are fixed to the outer shell 1 of the ski boot and project beyond the surface thereof.

Figure 4:
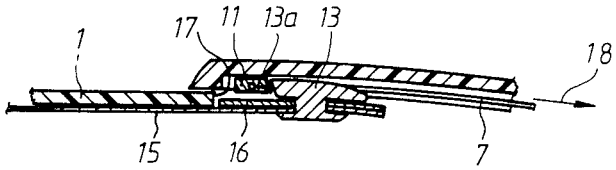
FIG. 4 is a section along the line IV—IV in FIG. 2.

As FIG. 4 shows, the anchor element 13 (the same applies to the element 14) is constructed in its lower region as a rivet and is connected to a tie rod 15 made from steel with a plate 16 interposed. The tie rod 15 is fixed to the shell 1, or to an abutment in the boot adjacent the heel area thereof, and transmits the forces exerted on the element 13 of the fastening member 7 to the shell or heel portion of the ski boot. The plate 16 covers a recess 17 which is provided in the plastic shell 1 of the ski boot and through which the element 13 is guided towards the exterior.

As can be seen from FIG. 4, that surface 13*a* of the element 13 remote from the boot opening and which is intended for engagement with the fastening member 7 is undercut. In the region of the recess 11*b* the slide 11 is provided with a complementary bevel. In this way the slide 11 and the anchor element 13 are secured against accidental release when traction is exerted by the fastening member 7 in the direction of the arrow 18 on the element 13.

In the embodiment shown in FIGS. 5 and 6 the anchor element 13' is also constructed as a rivet and connected to the tie rod 15 with the plate 16 interposed. Here the element 13' supports a link 19 which is capable of limited pivoting about a pin 20 and normally is held in known manner in the position shown in FIG. 5 by means of a torsion spring (not shown). The surface 19*a* of the link 19 facing the slide 11 is inclined in the manner already explained in connection with FIG. 4, in the same way as the surface of the slide 11 which engages therewith.

When the tongue is in its closed position and the operating member is in its latching position, the fastening member 7 exerts traction on the link 19 in the direction of the arrow 18 by means of the slide 11, then this traction is transmitted via the pin 20 to the element 13' and thence to the tie rod 15, since the line of action of the traction force (arrow 18) is lower than the pin 20. The link 19 is thus held satisfactorily in the closed position.

However, if the closure operating member 6 is turned to its unlatching position, the fastening member 7 is thereby relieved of strain and the tongue 3 with the fastening member 7 supported thereon is pushed forwards (see FIG. 6), then the link 19 is acted upon by a force component which pivots the link about the pin 20 against the force of the torsion spring (not shown) in the clockwise direction. In this way the slide 11 is released from the link 19 even if it has stuck in the guide recess 9 for some reason.

In the embodiment shown in FIGS. 7 and 8 the fastening member 7 which is constructed as a tie loop is guided directly into notch-like lateral widenings 9'*a* in the recess 9' (naturally the same applies to the fastening member 8). In the region of the outer end of the fastening member 7 a tubular semi-circular reinforcement 21 is arranged over the tie loop forming the fastening member 7. It ensures that the fastening member 7 only leaves the lateral widening 9'*a* of the recess 9' which serves as a sliding guide shortly before its outer end. The element 13 which is connected to the plastic shell 1 and with which the fastening member 7 engages by means of the tubular reinforcement 21 is shown in FIG. 7 by broken lines. On closure of the tongue, in order to ensure a smooth engagement of the elements 13 and 14 fixed on the plastic shell 1 in the recesses 9 (or 9', 10) of the tongue, the inside width a (FIGS. 2, 7) of these recesses is chosen so that it is markedly greater than the breadth b of the elements 13, 14.

In the open or unlatching position of the closure operator 6 is an inner spacing c between the free end of the fastening member and the appertaining anchor element (e.g., 13), see FIG. 7. If the closure operator is rotated to its latching position, then the free end of the fastening member 7 moves closer to the element 13 (with the distance c being reduced to zero) until finally the fastening member 7 (or slide 11 or reinforcement 21) bears firmly on the element 13 under tractive force.

As can be seen from the drawings, the fastening members 7, 8, the parts serving to guide the fastening members, and the elements 13, 14 which are connected to the plastic shell 1 and on which the fastening members 7, 8 engage are reliably protected against being coated with ice since they are arranged on the underside of the tongue and are completely covered thereby in use.

Figure 9:
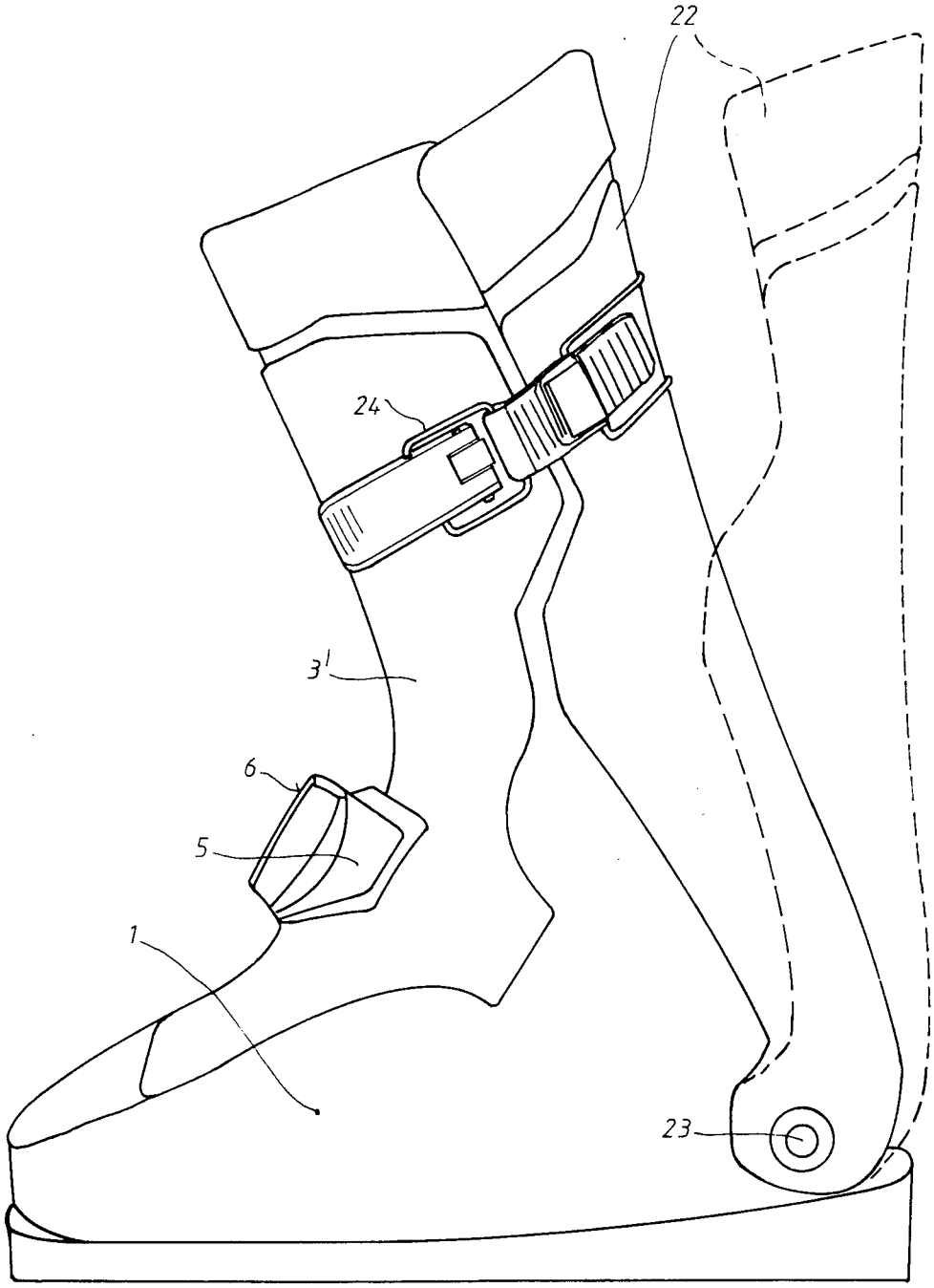
FIG. 9 is a perspective view of a further embodiment of the ski boot according to the invention.

In the embodiment shown in FIG. 9 the tongue 3' is integrally joined at its lower end to the plastic shell 1 forming the outer boot, but nevertheless may have its upper end pushed forwards and backwards to a limited extent. The fastening members 7, 8 (not visible in FIG. 9) 5 cooperate here in the same way with hook-like anchor elements 13, 14 which are fixed to the shell 1 of the ski boot.

Stepping into and out of the ski boot is facilitated by means of a shell portion 22 (a so-called spoiler) which can be pivoted backwards and forwards about a hinge 23 so that when the boot is worn the shell 1, the shell portion 22, and the tongue 3' may be held together by a closure strap 24.

What is claimed is:

1. In a ski boot constuction having an outer boot provided with a frontal opening, a closure tongue overlying said opening and extending beyond both sides of said opening, a movable operating member carried by said tongue, a pair of fastening members connected to said operating member and extending in opposite directions therefrom beyond both sides of said opening, said fastening members being movable transversely of said opening in response to movement of said operating member, and anchor members carried by said boot on opposite sides of said opening for releasable latching engagement by the respective fastening members, the improvement wherein said tongue has a dimension sufficient to overlie wholly said fastening members and both of said anchor members when said fastening members are in latching engagement with said anchor members.

2. The construction according to claim 1 wherein said tongue has lateral extensions on opposite sides thereof of such length as to project beyond said anchor members.

3. The construction according to claim 1 wherein said tongue is relieved on its underside for the accommodation of said fastening members.

4. The construction according to claim 1 wherein said fastening members comprise traction elements terminating in loops for receiving the respective anchor members.

5. The construction according to claim 1 including means for guiding said fastening members in their movements.

6. The construction according to claim 5 wherein the guiding means comprises two grooves in the underside of said tongue and a slide in each of said grooves, said slides being connected to said fastening members.

7. The construction according to claim 6 wherein said slides and said grooves are of complementary T-shape.

8. The construction according to claim 1 wherein each of said anchor members projects beyond said outer boot and has that surface thereof remote from said opening undercut.

9. The construction according to claim 1 wherein each of said anchor members is fixed on said outer boot.

10. The construction according to claim 1 wherein each of said anchor members comprises a link pivoted on said outer boot.

11. The construction according to claim 1 including means hingeing said tongue to said outer boot.

12. The construction according to claim 1 wherein said tongue is integrally joined at its lower end to said outer boot.

* * * * *